US010932549B1

(12) United States Patent
DeMaio

(10) Patent No.: US 10,932,549 B1
(45) Date of Patent: Mar. 2, 2021

(54) BEACH CHAIR

(71) Applicant: Matthew DeMaio, Valley Stream, NY (US)

(72) Inventor: Matthew DeMaio, Valley Stream, NY (US)

( * ) Notice: Subject to any disclaimer, the term of this patent is extended or adjusted under 35 U.S.C. 154(b) by 0 days.

(21) Appl. No.: 16/738,655

(22) Filed: Jan. 9, 2020

(51) Int. Cl.

| | |
|---|---|
| ***A45F 4/02*** | (2006.01) |
| ***A45F 3/04*** | (2006.01) |
| ***A47C 4/30*** | (2006.01) |
| ***A45F 3/14*** | (2006.01) |
| ***A47C 7/62*** | (2006.01) |

(52) U.S. Cl.
CPC ..... *A45F 4/02* (2013.01); *A45F 3/04* (2013.01); *A45F 3/14* (2013.01); *A47C 4/30* (2013.01); *A47C 7/622* (2018.08); *A45F 2003/045* (2013.01); *A45F 2003/142* (2013.01); *A45F 2004/026* (2013.01)

(58) Field of Classification Search
CPC ..... A45F 4/02; A45F 2004/026; A45F 3/04; A45F 3/14; A47C 4/28; A47C 4/52; A47C 4/30; A47C 7/622
See application file for complete search history.

(56) References Cited

U.S. PATENT DOCUMENTS 5,297,708 A 3/1994 Carpenter
5,318,342 A * 6/1994 Hale ..... A47C 4/52 297/129
5,409,291 A * 4/1995 Lamb ..... A01K 97/10 224/155
5,501,505 A * 3/1996 Jablonski ..... A47C 1/143 224/155
5,527,088 A * 6/1996 MacLean ..... A45F 4/02 224/155
5,988,737 A * 11/1999 Tomaiuolo ..... A47C 4/52 297/129
7,118,172 B1 * 10/2006 Pattison-Sheets ..... A45F 4/02 297/129
8,197,000 B1 * 6/2012 Cohen ..... A47C 7/622 297/17
2013/0126566 A1 5/2013 Seuk
2017/0127837 A1 * 5/2017 Brune ..... E04H 15/008
2018/0332953 A1 * 11/2018 Solomon ..... A47C 4/20

* cited by examiner

*Primary Examiner* — Corey N Skurdal
(74) *Attorney, Agent, or Firm* — Tod M. Melgar

(57) ABSTRACT

A portable backpack chair with gear carrying webbing for use in efficiently carrying gear for camping, the beach or the like. The backpack chair provides a novel design that eases the ability to carry a collapsible chair, such as a beach chair, on the user's back along with accompanying gear such as a cooler, beach towel and supplies. The novel design comprises a beach chair with an pack carrier portion and support structure mounted to the bottom portion of the beach chair, and chair back and seat portions that include a plurality of rows of cross webbing fixedly connected to the chair backing and seat fabric at intervals whereby securing straps can be used to attach gear to the fabric portion by looping the securing straps through a spaces between the fabric and the webbing. The portable backpack chair allows the user to quickly and easily pack and carry a chair and gear with minimal effort.

16 Claims, 6 Drawing Sheets

BEACH CHAIR

FIELD

The present innovations generally relate to an improved portable foldable chair, and more particularly to a foldable chair such as a beach chair adapted to include gear carrying webbing and a backpack or ruck sack frame to strengthen the chair and increase load capacity and having backpack carried straps for carrying the entire assembly on the users back. While discussed and shown in the context of a beach style chair below, the disclosure is not so limited and it will be understood to be useful in conjunction with other foldable chairs.

BACKGROUND

When traveling over land to the beach or other recreational activities where it is useful or enjoyable to have a chair, along with other gear, such as, a towel, cooler, sunscreen and the like. It is often difficult, however, for one person to comfortably and efficiently carry the chair and gear, especially when traversing any significant distance from their car, home or hotel. Traditionally people carried a chair in one hand and a sack in the other or backpack on their back. Carrying a chair in the user's hand, however, can get tiring over long distances and also typically leaves the bottom of the chair hanging low to the ground where it bangs into other objects including the carrier's legs as they walk. Others have developed backpack chair carriers, rolling chair carrying carts and the like in an attempt to alleviate some of these problems. The cart solutions are large, unwieldy and can get bogged down and be hard to pull through loose sand or over terrain especially when carrying a cooler or other gear of significant weight. Known combination backpack chairs, some with gear carrying solutions, resolve or limit some of the issues with a cart in that there are no wheels to get stuck in the sand or traverse rough terrain. The known backpack chairs however typically only carry gear or components designed specifically to attach to a chair or be permanently connected to the chair. As a result, users are unable to readily attach gear or equipment not specifically designed to be carried with the chair. Moreover, the known designs a lack the support and strength to carry heavy loads. For the forgoing reasons, there is a need for an improved gear carrying backpack chair with universal attachment points that is simple to use, can carry any type of gear and which does not impede the wearer's movement.

SUMMARY

The present disclosure solves the above needs and deficiencies by providing a novel backpack beach chair and gear carrier that in various embodiments has an integrated pack frame mounted to the bottom portion of the chair and/or a chair back formed of base material wherein the back portion of the base material has a plurality of universal attachment points arranged in rows. In conjunction with these improvements the rows of attachment points in the present disclosure are preferably provided by a plurality of rows of webbing material sewn to the base material at intervals whereby a plurality of openings or spaces are formed between the back material and the webbing in each row. In various alternate embodiments of the disclosure, the rows of webbing are similar to MOLLE (MOdular Lightweight Load-carrying Equipment), which refers to any modular attachment system that utilizes the Pouch Attachment Ladder System (PALS) for mounting modular accessory components. In other embodiments, the attachment points or openings may be formed by pairs of slits in the base material. Using these pairs of slits or openings between the base material and webbing, gear can be attached to the back of the chair back material using for example straps or clips that can be looped through the slits or openings in the chair and a corresponding or similar attachment point of the gear to be carried. In further embodiments the chair includes shoulder straps for carry the chair on a user's back. In various embodiments the shoulder straps are mounted directly to the underside of the chair frame while in other embodiment the rigid pack frame with shoulder straps (like the frame of a ruck sack) is attached to the base of the chair to increase strength and load carrying capacity.

While the disclosure above and the detailed disclosure below are presented herein in the context of beach chair, it will be understood by those of ordinary skill in the art that the concepts may be applied to other types of chairs and activities in various ways where there is a beneficial advantage to efficiently carry a foldable chair and gear. With the foregoing overview in mind, specific details will now be presented, bearing in mind that these details are for illustrative purposes only and are not intended to be exclusive.

BRIEF DESCRIPTION OF THE DRAWINGS

The accompanying drawings illustrate various non-limiting examples and innovative aspects of the beach chair in accordance with the present description.

DETAILED DESCRIPTION

Figure 1:
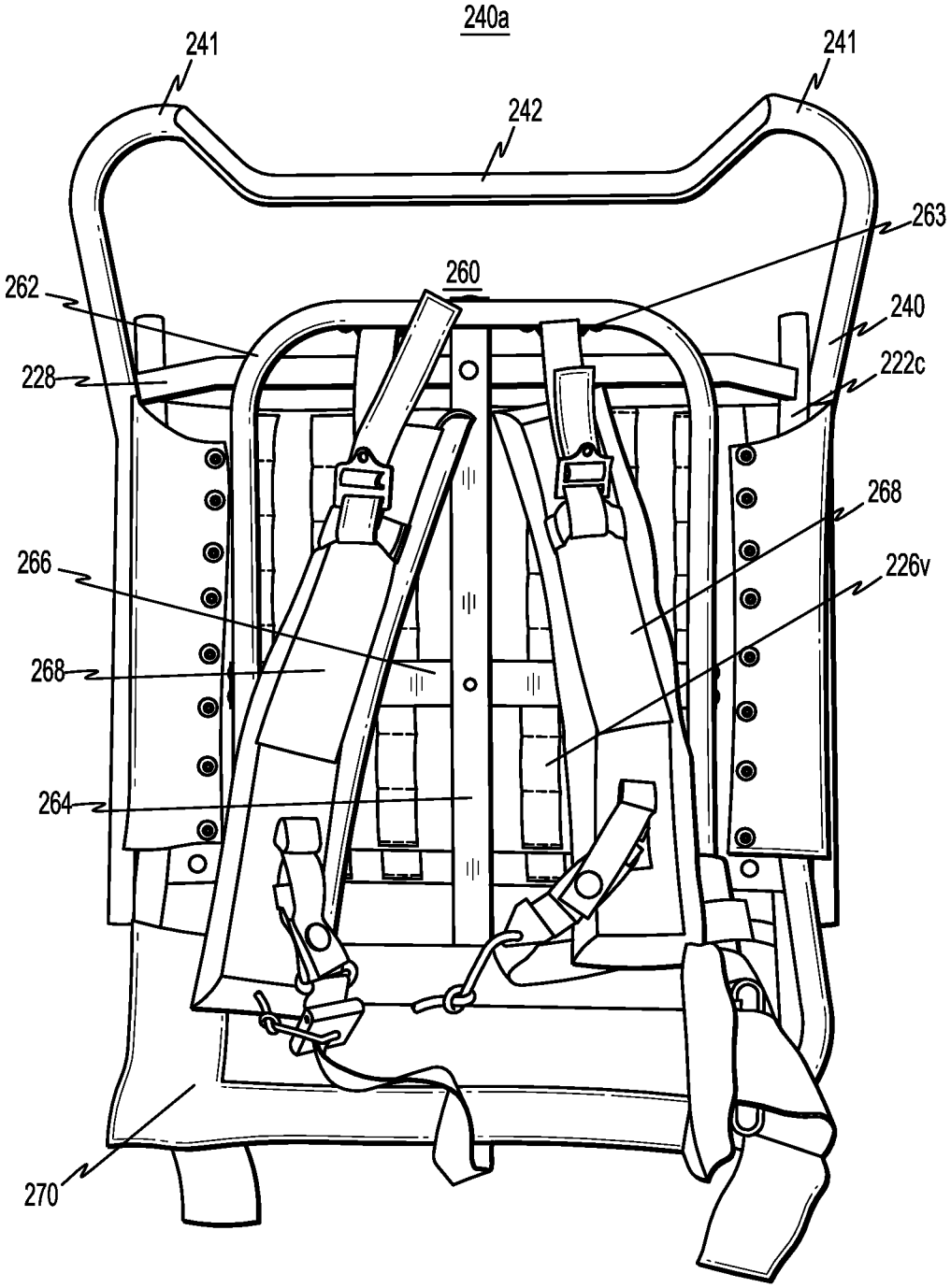
FIG. 1 shows a back view of one embodiment of the backpack chair in a closed state with pack carrier.

In simplified overview, an improved backpack chair with gear carrying attachment points for use in recreational, vocational or other activities where a person is traveling on foot with a chair and gear is described herein. While the disclosure will describe the backpack chair primarily in the context of recreational usage such as traveling to the beach those skilled in the art will understand that the novel attributes of the disclosure are useful in a multitude of other endeavors including other recreational activities as well as in professional and military roles, where for example technicians conducting field repairs might need tools and seating.

A recreational trip to the beach is an activity enjoyed by millions. While being at the beach is enjoyable, getting there and back can be less so. A trip to the beach typically involves a desire to bring beach gear (e.g., a chair, cooler, towel, umbrella, beach games, and the like) and to reach the shoreline typically requires traveling with all of your gear by foot over significant distances from a home, hotel or beach parking lot. The backpack chair with universal gear attachment points and ruck sack frame disclosed herein facilitates the carrying of all of a beach goer's gear compactly and efficiently so that the user can carry everything they need over significant distances with ease.

Specifically, in the disclosed embodiments, the novel design includes a foldable chair adapted with one or more of a backpack or ruck sack frame for carrying the chair on the user's back, and/or a chair back support material that includes a plurality of universal attachment points wherein a user can attach or clip gear securely to the back of the chair. In this way, the attachment points allow user's to attach gear directly to the chair and the ruck sack frame strengthens the chair frame and increases load carrying capacity. These novel design features allow a user to carry all of their gear efficiently on their back, leaving their hands free to hold a child's hand, carry a drink or use walking sticks. In various embodiments, the attachment points are included preferably on the back of the material covering the back potion of the chair whereby whether in the closed or opened position the attachment points and gear can hang on the back of the chair. In other embodiments, the front or seating side of the back support material, and one or both sides of the base seating surface, may also have attachment points for locking or securing the chair in the closed position, for other useful purposes such as securing a towel to cover the chair when opened on the beach or for aesthetics so all chair surfaces look uniform.

The features of the disclosed foldable backpack chair are discussed in further detail below in conjunction with the figures. While specific details of the features and shapes may be provided by example, it will be understood by those of skill in the art that the backpack chair can be varied in style, size and shape and/or as components to modify an ordinary foldable chair and still provide the inventive features.

Foldable Chair Structure

Figure 2:
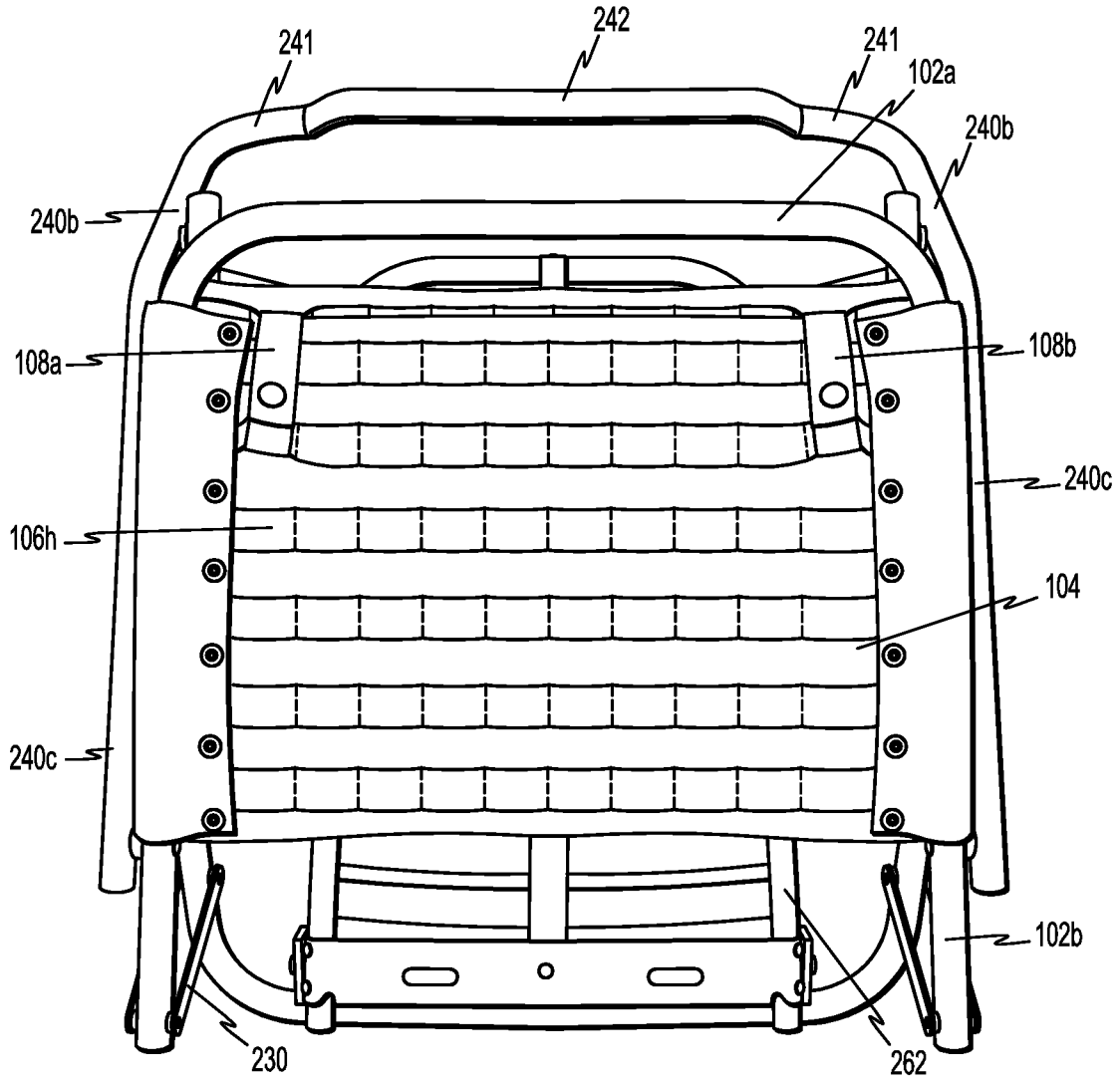
FIG. 2 shows a front view of one embodiment of the backpack chair in a closed state with gear carrying attachment points.
Figure 3:
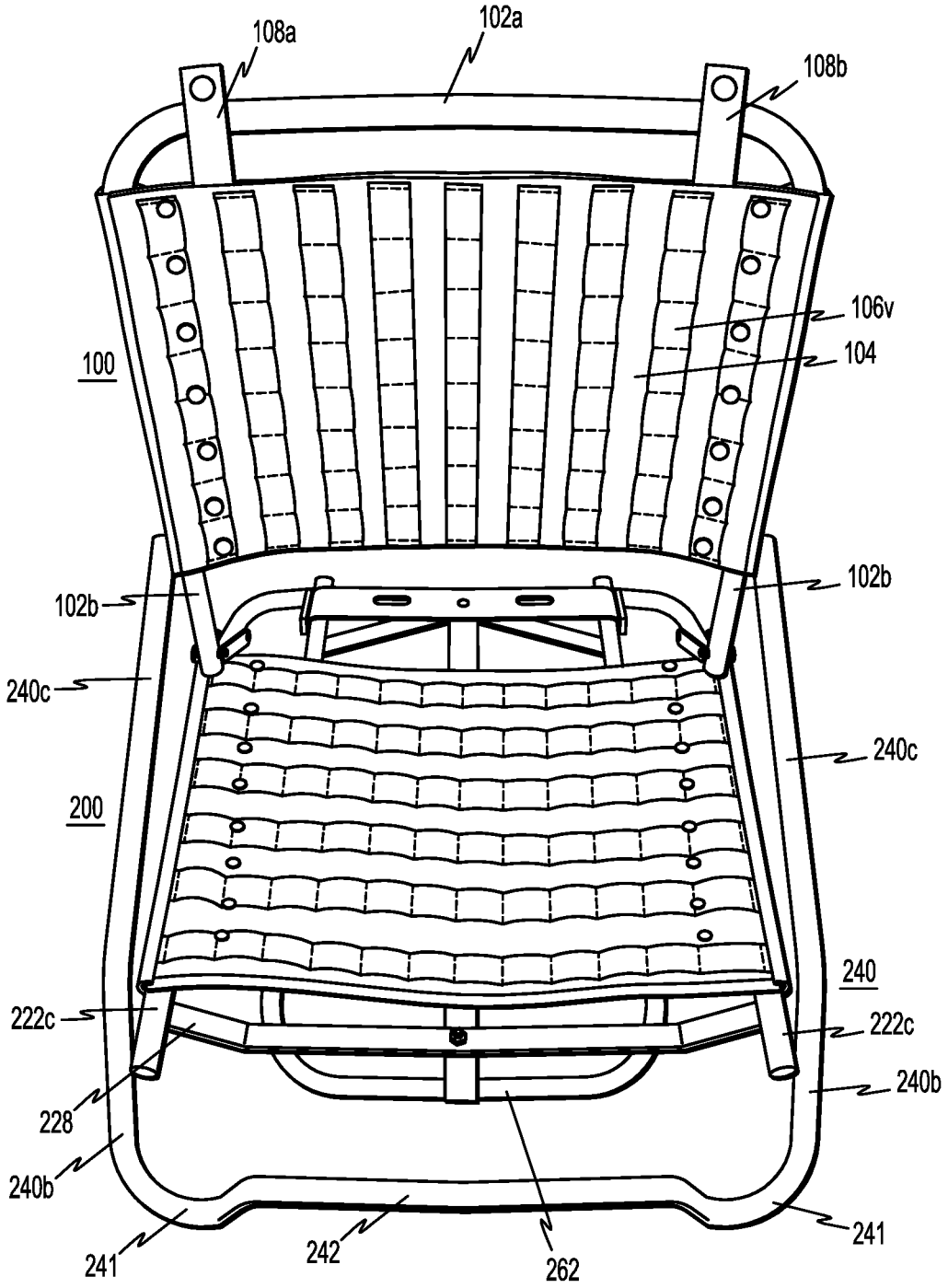
FIG. 3 shows a seating surface side perspective view of one embodiment of the backpack chair in an open state.
Figure 4:
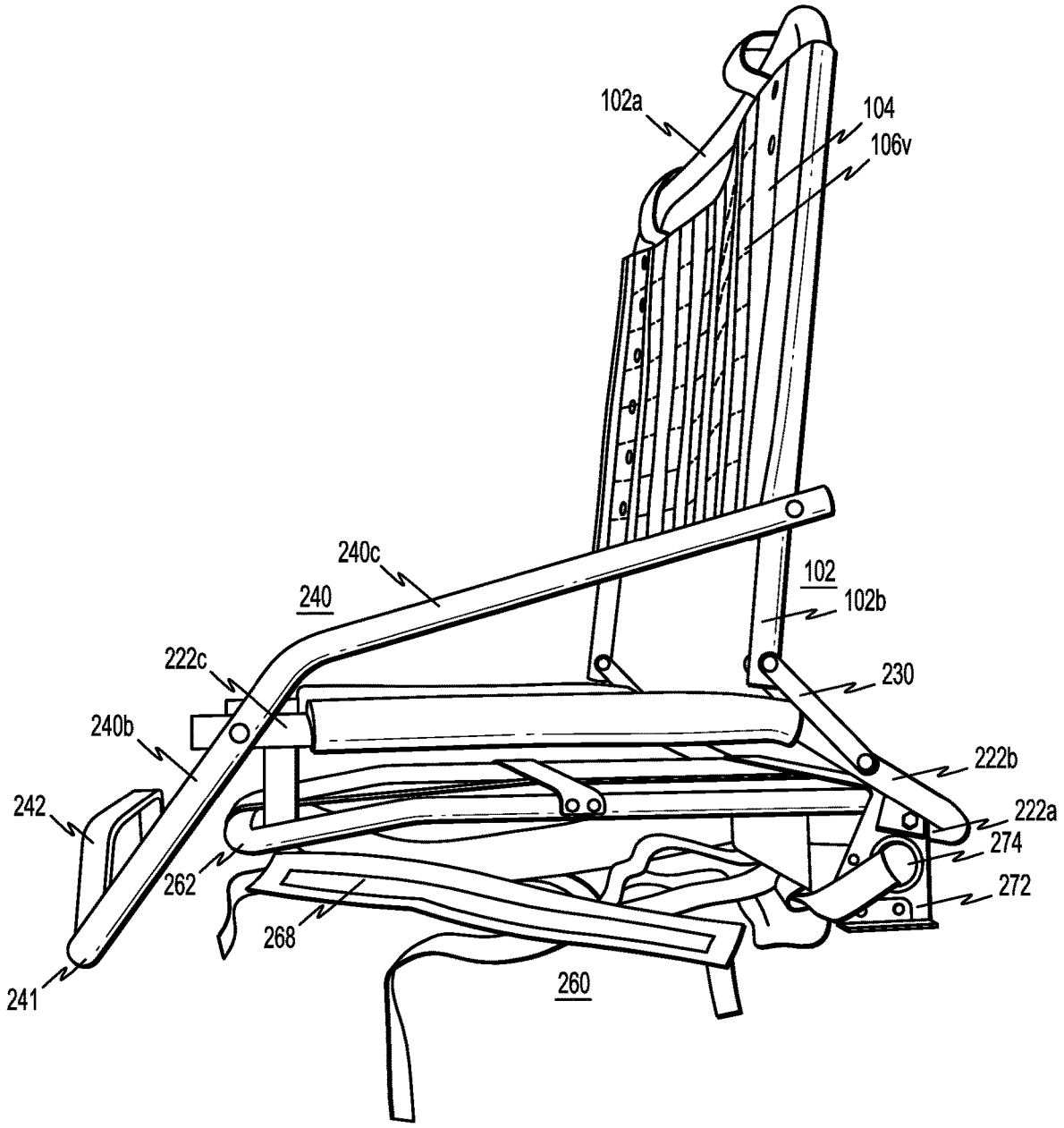
FIG. 4 shows a side view of one embodiment of the backpack chair in an open state.

Referring to FIGS. 1-6 and in particular FIG. 3, the backpack chair comprises two primary portions—a chair back 100, and a chair base 200 wherein the chair back 100 and chair base 200 are hingedly attached by hinge arm 230 so that the chair is adjustable between an open position (see FIGS. 3-6) and a closed position (see FIGS. 1-2).

The chair back 100 preferably comprises a u-shaped back frame 102, a back support material 104 spanning the u-shaped back frame 102, and securing straps 108*a*, 108*b* for securing the chair in a closed position during transport (see FIG. 2).

The u-shaped back frame 102 is preferably oriented so that the top 102*a* of the u-shaped is at the top of the chair and two side extensions 102*b* of the u-shape extend downward toward, and are hingedly attach to, the chair base 200.

The back support material 104, as discussed in further detail below with respect to gear carrying, is adapted with a plurality of attachment points or openings 107, preferably by attaching a plurality of rows of webbing 106*h, v* bartacked at intervals to the back support material 104, similar to MOLLE or PALS for mounting modular accessory components as discussed above.

The chair base portion 200 comprises a seat portion 220 and an support frame portion 240, and a pack carrier portion 260.

Figure 5:
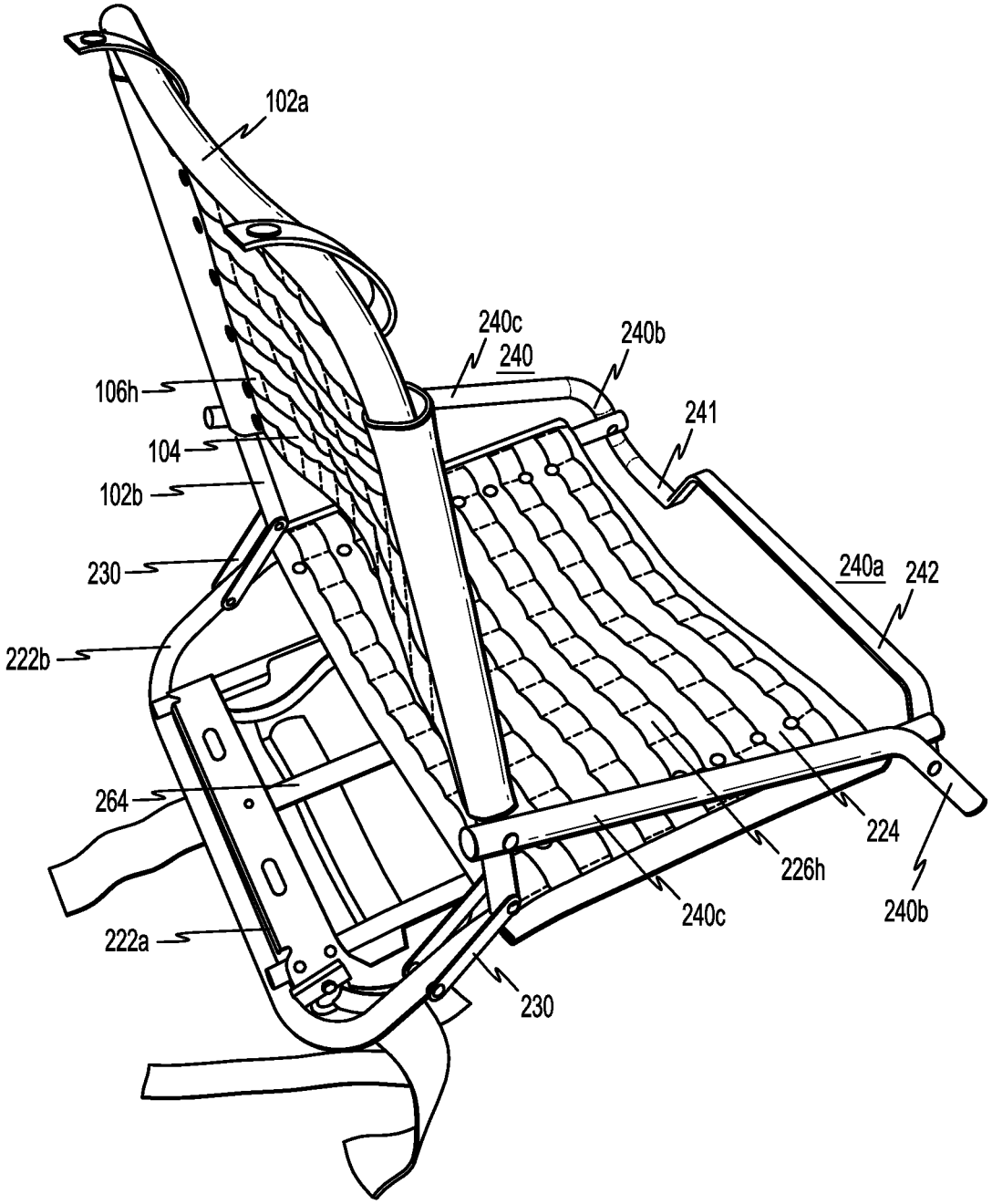
FIG. 5 shows a side perspective view of one embodiment of the backpack chair in an open state.

The seat portion 220 comprises a u-shaped seat frame 222 and seat support material 224 spanning the seat frame 222. Referring to FIG. 5, the u-shaped seat frame 222 is shaped and oriented so that in the chair open position the base 222*a* of the u-shape is positioned at the rear of the chair near or on the ground with the legs 222*b* of the u-shape extending at an angle upward and toward the front of the chair and then bending into side rails 222*c* at a substantially horizontal orientation and extending toward the front of the chair. This configuration is designed so that the base 222*a* of the seat frame 222 may support and hold the back of the seat portion above the ground. The seat support material 224 preferably spans the seat frame 222 along the horizontally oriented side rails 222*c*. The seat support material 224, like the back support material 104, may also be adapted with gear attachment points 107. The side extensions 102*b* of the u-shaped back frame 102 are generally received and hingedly attached to the legs 222*b* of u-shaped seat frame 222. The hinged connection may be by any known means such as by a hinge arm 230. In various embodiments the forward ends of the seat frame side rails 222*c* are connected by a horizontal support bar 228 which provides rigidity to the frame, as well as, an attachment point for the pack carrier 260 as discussed in further detail below.

The support frame 240 of the chair base 200 supports and holds the front of the chair off of the ground, holds the chair back 100 in the position against a person's weight when leaning on the chair back 100, and provides an armrest. Like the seat frame 222—but with the u-shape facing the opposite direction—the base 240*a* of the u-shape support frame 240 is oriented and positioned so that the base 240*a* of the u-shape is near or on the ground. Extending from each side of the base 240*a* is a leg potion 240*b* angled up and toward the back of the chair, which then bend downward toward the horizontal to form an armrest extension 240*c* on each side that extend to the back of the chair at a slight upward angle. The ends of the armrest extensions 240*c* hingedly connect to the side extensions 102*b* of the back frame 102 at a point above the hinge arm 230. The ends of the seat frame side rails 222*c* of the seat frame 222 hingedly connect to the leg portions 240*b* of the support frame 240. The base 240*a* of the support frame 240 is also preferably formed from two foot portions 241, one on each side, joined together by a recessed portion 242. The recessed portion 242 of the base 240*a* is advantageously configured to prevent the base 240*a* from hitting the wearer's neck when the chair is being carried.

A pack carrier 260 is preferably attached to the underside of the chair base 200 for carrying the chair when in a closed position. With reference to FIG. 1, the pack carrier 260 preferably includes at least a first and second shoulder straps 268 attached to an underside of the chair base 200. The shoulder straps 268 are preferably oriented so that the top of the shoulder straps 268 are attached proximate the front of the chair (i.e., proximate to the horizontal support bar 228 or support frame base 240*a*) and the bottom of the shoulder straps 268 are attached proximate the back of the chair (i.e., proximate to the seat frame base 222*a*). In this way when the chair is on the wearer's back, the base 240*a* of the support frame 240 is positioned adjacent the wearer's neck and the base 222*a* of the seat frame 222 is positioned adjacent the wearer's hip. Because the chair when positioned on the user's back is oriented so that the chair back is biased to the open position under its own weight, securing means such as securing straps 108*a,b* can be used to retain the chair in the closed position. In alternate embodiments the orientation of the shoulder straps 268 may be reverse so that the base 240*a* of the support frame 240 is positioned adjacent the wearer's waist and the base 222*a* of the seat frame 222 is positioned adjacent the wearer's hip. In this orientation the base 222*a* of the seat frame 222 would have a recessed position similar the recessed portion 242 of the support frame 240 so that the frame does not contact the wearer's neck while walking.

This orientation relieves the need for securing means to keep the chair closed since it is biased closed under the chair's own weight, however, as will be understood in conjunction with the gear carrying capabilities discussed further below, the attached gear would be in an opposite vertical orientation (or, upside down) when on the wearer's back as compared to when the chair is in the open position.

In some embodiments, the tops of the shoulder straps 268 may be connected directly to the horizontal support bar 228 of the seat frame 222 or the base 240*a* of the support frame 240, and the bottom of the shoulder straps 268 may be connected to directly to the of the base 222*a* of the seat frame 222. In other embodiments, the pack carrier 260 may further comprise a pack frame 262 to strengthen the chair, increase gear load capacity and better position the chair and load on the user's back. Referring to FIGS. 1, 3, 4 and 5, the pack frame 262 may be a rectangular shape or u-shaped closed with a horizontal end bar 276 and attached to the underside of the chair base 200, with an upper end of the pack frame 262 attached to the horizontal support bar 228 of the seat frame 222 and a lower end of the pack frame 262 connected to the base of the seat frame 222. The shoulder straps 268 are in turn each connected at one end to an upper end of the pack frame 262 and the other end to a lower end of the pack frame 262 or horizontal end bar 276. In some embodiments, the upper end of the seat frame includes shoulder strap attachments points 263 (see FIG. 1) for attaching an upper end of the shoulder straps 268 and the lower end of the seat frame includes hip belt attachment points 274 for receiving the lower end of the shoulder straps 268 and connecting a hip belt 270.

Referring to FIGS. 1 and 3, in some embodiment, pack frame 262 further includes vertical cross bar 264 and horizontal cross bar 266 to strengthen the pack frame 262. In yet further embodiments, the pack frame 262 or base of the seat frame 222 may include rear feat 272. The rear feet 272 may serve to provide extra ground clearance so that the weight of the chair and user are not placed by the base 222*a* of the seat frame 222 onto the hip belt 270. The feet 272 additionally give the chair and user more stability in the sand or other soft ground, especially when the feet are provided with a larger contact surface area than the base 222*a*.

The pack carrier as described above may be fixedly attached to the chair disclosed or may be provided as a removable accessory to be added to an existing chair, whereby the pack frame 262 includes screw clamps or other fixing devices to secure the pack carrier to the underside of an existing chair.

Gear Carrying Systems

As discussed above, the disclosure provides for a plurality of rows of universal attachment points or openings 107 similar to MOLLE or PALS webbing. Namely, these may be rows of heavy-duty material such as canvas or nylon precisely stitched or bartacked at intervals onto a fabric (connecting points) so as to form a plurality of openings or gear attachment points where a strap or clip can be looped to secure gear.

Figure 7:
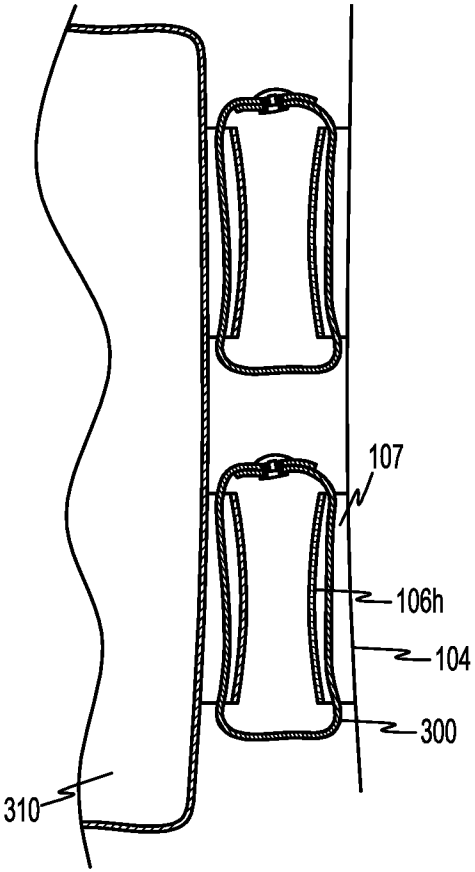
FIG. 7 shows a side cutaway view of the attachment points and opening on the back of the backpack chair support material.
Figure 6:
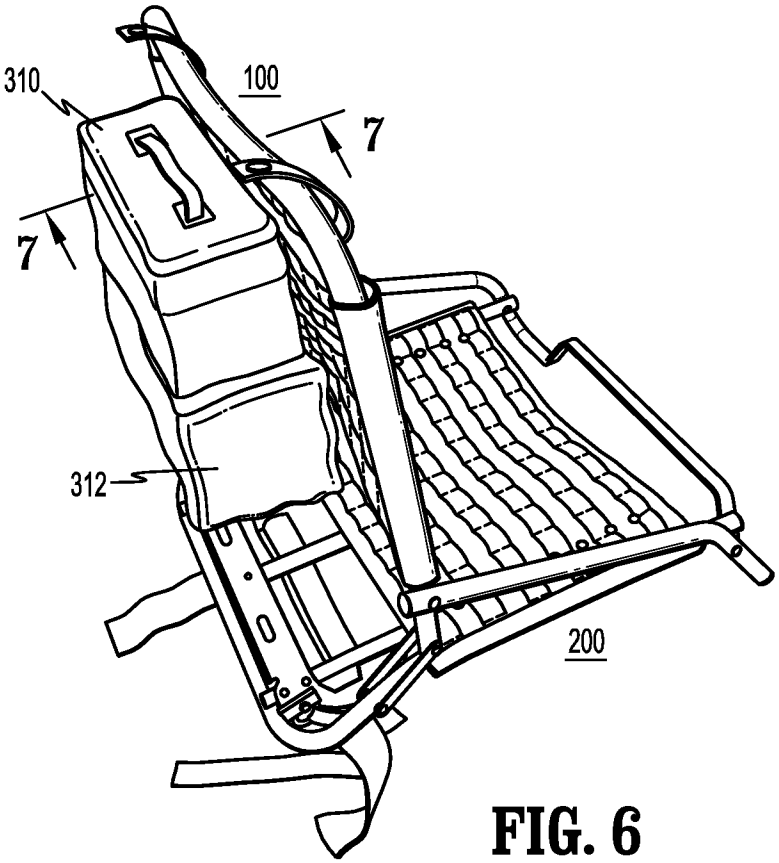
FIG. 6 shows a side perspective view of one embodiment of the backpack chair in an open state and with exemplary attached gear.

Referring to FIGS. 1, 6 and 7, the webbing 106*h* is preferably provided in a plurality of horizontal rows of webbing stitched or bartacked at intervals (connecting points that are evenly or unevenly spaced) to the back of the back support material 104. Referring to FIG. 7, a cross-section of the back support material 104 and webbing 106*h* is shown. By stitching or bartacking the webbing in intervals (connecting points) a plurality of openings or gear attachment points 107 are formed between the webbing 106*h* and the surface of the back support material 104. Each opening or attachment point 107 provides for a gear carrying attachment point by which gear 310, 312 can be easily attached to the backpack chair and carried. For example, as shown a gear strap or clip 300 can be looped through the opening 107 and a corresponding attachment means on the gear to secure the gear 310, 312.

The webbing may by example consist of horizontal rows 106*h* of one inch Type III nylon webbing vertically spaced one inch apart on the gear carrying side 104*b*, and be attached by reinforced stitches or seams to the backing at one and one-half inch intervals. In some embodiments, the seating side 104*a* of the back support material may contain vertical rows 106*v* of similar webbing space and tacked at similar intervals. The vertical webbing 106*v* (see FIG. 3) not only provides additional gear attachment points but also strengthens the back support material and carries the load of the horizontal gear attachment points 107. The vertical webbing 106*v* on the seating surface of the chair may, for example, be used to secure a towel to the chair surface. In some embodiments the vertical webbing 106*v* may extend beyond the fabric and attach to top frame 102*a* of the back frame 102 to further enhance the gear carrying capacity.

In some embodiments the upper surface of the seat support material 224 may also include a plurality of horizontal rows of webbing 226*h* extending in a direction across the chair, and the underside or lower surface includes a plurality of rows of webbing 226*v* extending in a direction from front to back, thus creating openings and gear attachment points 107 on all surfaces. With reference to FIG. 2, securing straps 108*a, b* can be looped through gear attachment points on the upper surface of the seat support material 224 to secure the chair in the closed position for carrying.

In yet other embodiments, the openings 107 may be formed by cutting adjacent slots in the back support material 104 or seat support material 224 whereby a strap or clip 300 can pass through the slits to secure gear 310, 312 to the chair.

In some embodiments the back support material 106 with webbing 106*h, v* may be adapted to be sold as an add on to exiting chairs. In this case it will be understood that he back support material can be formed as a sleeve to slide over the top of an existing beach or other chair, or the back support material 106 may be provided as a kit to replace the material on an existing chair. In this way, in combination with a detachable pack carrier, an existing chair can be adapted.

It should be understood that this description (including the figures) is only representative of some illustrative embodiments. For the convenience of the reader, the above description has focused on representative samples of all possible embodiments, and samples that teach the principles of the disclosure. The description has not attempted to exhaustively enumerate all possible variations. That alternate embodiments may not have been presented for a specific portion of the disclosure, or that further undescribed alternate embodiments may be available for a portion, is not to be considered a disclaimer of those alternate embodiments. One of ordinary skill will appreciate that many of those undescribed embodiments incorporate the same principles of the disclosure as claimed and others are equivalent.

What is claimed is:

1. A portable backpack chair comprising:

a chair back hingedly connected to a chair base and adapted to pivot between an opened position and a closed position;

the chair back comprising a back frame and a back support material wherein the back frame comprising a top portion and a first and second side extensions extending from the top portion in spaced relation, and the back support material is attached to the first and second side extensions and spans a space between the first and second side extensions, the back support material having a seating side and a gear carrying side wherein the gear carrying side has a plurality of rows of horizontally spaced openings wherein the openings are adapted to receive a strap or clip;

the chair base comprising a seat portion, a support frame and a pack carrier;

the seat portion comprising a seat frame and a seat support material, the seat frame having a seat frame base, a first and second seat frame legs extending from the base and a first and second seat frame side rails extending from the seat frame legs in spaced relation, and the seat support material attached to the first and second seat frame side rails and spanning a space between the first and second seat frame side rails;

the support frame comprising a support frame base, a first and second support frame legs extending from the support frame base and a first and second armrest extensions extending from the support frame legs; and the pack carrier comprises a first and second shoulder straps attached to an underside of the chair base portion.

2. The portable backpack chair of claim 1, wherein:

wherein the plurality of rows of horizontally spaced openings on the gear carrying side are formed between the back support material and rows of horizontal webbing fixedly connected to the gear carrying side of the back support material at a plurality of horizontally spaced connecting points wherein an opening is formed between a pair of horizontally spaced connecting points.

3. The portable backpack chair of claim 2, further comprising a plurality of vertical columns of webbing fixedly connected to a seating side of the back support material at a plurality of vertical spaced connecting points wherein an opening is formed between a pair of vertically spaced connecting points.

4. The portable backpack chair of claim 1, wherein the plurality of horizontally spaced openings on the gear carrying side are formed by rows of slots in the back support material at intervals in the horizontal direction.

5. The portable backpack chair of claim 1, wherein the support frame base comprises a first and second foot portions in spaced relations and connected by a recessed portions.

6. The portable backpack chair of claim 1, wherein the chair back and chair base further comprises a securing means for fixing the portable backpack chair in the closed position for carrying.

7. The portable backpack chair of claim 6, wherein the chair back further comprises a strap affixed proximate a top of the chair back and adapted to loop through an opening in the seat support material.

8. The portable backpack chair of claim 1, wherein the chair base further comprise a strap located at a forward portion of the chair base and adapted to loop through an opening in the back support material.

9. The portable backpack chair of claim 1, wherein the pack carrier further comprises a pack frame attached to an underside of the seat frame and wherein the shoulder straps are attached to the pack frame.

10. The portable backpack chair of claim 9, wherein the pack frame further comprises a hip belt.

11. The portable backpack chair of claim 9, wherein the pack frame further comprises two rear feet.

12. A portable backpack chair comprising:

a foldable chair having a chair back hingedly connected to a chair base and adapted to pivot between an opened position and a closed position;

a back support material adapted to be attached to a chair back, the back support material having a seating side and a gear carrying side wherein the gear carrying side has a plurality of rows of horizontally spaced openings wherein the openings are adapted to receive a strap and wherein the rows of horizontally spaced openings on the gear carrying side are formed between the back support material and rows of horizontal webbing fixedly attached to the gear carrying side of the back support material at a plurality of horizontally spaced attachment points wherein an opening is formed between a pair of horizontally spaced connecting points; and a pack carrier adapted to be removably attached to the underside of a chair base portion, wherein the pack carrier comprises a first and second shoulder straps for carrying the chair on a user's shoulders.

13. A portable backpack chair comprising:

a chair back hingedly connected to a chair base and adapted to pivot between an opened position and a closed position;

the chair back comprising a back frame and a back support material wherein the back frame comprising a top portion and a first and second side extensions extending from the top portion in spaced relation, and the back support material is attached to the first and second side extensions and spans a space between the first and second side extensions, the back support material having a seating side and a gear carrying side;

the chair base comprising a seat portion, a support frame and a pack frame;

the seat portion comprising a seat frame and a seat support material, the seat frame having a seat frame base, a first and second seat frame legs extending from the base and a first and second seat frame side rails extending from the seat frame legs in spaced relation, and the seat support material attached to the first and second seat frame side rails and spanning a space between the first and second seat frame side rails;

the support frame comprising a support frame base, a first and second support frame legs extending from the support frame base and a first and second armrest extensions extending from the support frame legs; and the pack frame comprising a u-shaped frame extending from an upper end to a lower end and attached to an underside of the seat frame, and a first and second shoulder straps wherein each shoulder strap has a first end attached to the pack frame proximate to upper end of the pack frame and a second end attached to the pack frame are proximate the lower end.

14. The portable backpack chair of claim 13, wherein the pack frame further comprises a hip belt attached to the pack frame proximate to the lower end of the pack frame.

15. The portable backpack chair of claim 14, wherein the pack frame further comprises two rear feet proximate the lower end of the pack frame configured to support the chair when in an opened position.

16. The portable backpack chair of claim 15, wherein the gear carrying side of the back support material has rows of horizontally spaced openings wherein the openings are adapted to receive a strap or clip.

* * * * *